US007758179B2

(12) United States Patent
Niekawa

(10) Patent No.: US 7,758,179 B2
(45) Date of Patent: Jul. 20, 2010

(54) INKJET RECORDING APPARATUS FOR EFFICIENTLY LIGHTING SEMICONDUCTOR LIGHT EMITTING ELEMENTS

(75) Inventor: Yukihiro Niekawa, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 247 days.

(21) Appl. No.: 11/953,740

(22) Filed: Dec. 10, 2007

(65) Prior Publication Data

US 2008/0278560 A1 Nov. 13, 2008

(30) Foreign Application Priority Data

Dec. 13, 2006 (JP) ..... 2006-335437

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

2001/0022610 A1* 9/2001 Ozawa ..... 347/223
2005/0168555 A1 8/2005 Niekawa
2005/0280683 A1* 12/2005 Custer ..... 347/102
2006/0050133 A1 3/2006 Kokubo
2006/0290760 A1* 12/2006 German et al. ..... 347/102

FOREIGN PATENT DOCUMENTS

EP 1 598 199 A2 11/2005

OTHER PUBLICATIONS

European Search Report dated Dec. 23, 2008.

* cited by examiner

*Primary Examiner*—Matthew Luu
*Assistant Examiner*—Shelby Fidler
(74) *Attorney, Agent, or Firm*—Finnegan, Henderson, Farabow, Garrett & Dunner, L.L.P

(57) ABSTRACT

An inkjet recording apparatus 1 is provided with: a recording head 10 to eject light-hardenable ink onto a recording medium S; a plurality of light sources 12*a* and 13*a* configured with semiconductor light emitting elements to radiate light onto the light-hardenable ink; a constant voltage power supply 14 to receive an alternating current and convert into a direct current power having a predetermined voltage; constant current circuits 15*a* and 15*b* to convert the direct current power supplied from the constant voltage power supply into a direct current power having a predetermined current value and to supply the direct current power to the light sources; and a control section 16 to control the current value of the direct current power supplied from the constant current circuits, where a plurality of the light sources are connected serially and a plurality of the constant current circuits are provided in accordance with number of blocks 11*a* and 11*b* which are configured with a plurality of light sources divided into a predetermined number of the light sources or number of a plurality of the light sources.

8 Claims, 5 Drawing Sheets

INKJET RECORDING APPARATUS FOR EFFICIENTLY LIGHTING SEMICONDUCTOR LIGHT EMITTING ELEMENTS

This application is based on Japanese Patent Application No. 2006-335437 filed on Dec. 13, 2006, in Japanese Patent Office, the entire content of which is hereby incorporated by reference.

BACKGROUND OF THE INVENTION

The present invention relates to an inkjet recording apparatus, and in particular to an inkjet recording apparatus where light-hardenable ink is hardened and fixed on a recording medium by radiating light.

As an image recording apparatus capable of recording an image not only on ordinary paper or textile but a medium having an inferior ink absorption property such as a resin film, there had been developed an inkjet recording apparatus in which a nozzle provided on an end face of a recording head ejects ink to land the ink on the recording medium. At the present day, this technology is applied to various technical fields. Among them, a light-hardenable type inkjet apparatus, where light such as ultra violet light is radiated onto the ink landed on the recording medium to harden and fix the ink, has been actively developed.

In such light-hardenable type inkjet recording apparatus, because a superior manageability of ink and a high recording quality can be obtained, ultra violet light hardenable ink hardened by radiation of ultra violet light is frequently used. Also, as a light source to radiate the ultra violet light onto the ultra violet light hardenable ink to hardened, a high pressure mercury lamp or low pressure mercury lamp have been used.

However, the high pressure mercury lamp and low pressure mercury lamp usually require to be applied by high tension alternate electric power of more than 100 V, thus there was dangerousness of electrification by contacting with a high voltage power source or a circuit when an operator place the hand inside the apparatus to handle paper jamming and so forth.

In recent years, a semiconductor light emitting element in particular ultra violet light emitting diode (UVLED) is attracting attention as a light source having advantages of long life and rapid start, and various inkjet recording apparatuses using the light thereof as the ultra violet light source have been developed (for example, Patent Documents 1-7).

The semiconductor light emitting element usually has an advantage that a light intensity can be adjusted in accordance with a current value of an electric current to be supplied, and can emit light with a low voltage direct current power, thereby being expected as a solution to solve the aforesaid problems which the high pressure mercury lamp and low pressure mercury lamp possess.

Patent document: Tokkai 2004-181943
Patent document: Tokkai 2004-237588
Patent document: Tokkai 2005-104108
Patent document: Tokkai 2005-144679
Patent document: Tokkai 2005-254560
Patent document: Tokkai 2006-27235
Patent document: Tokkai 2006-27236

Meanwhile, since the light intensity can be adjusted by changing current value, to efficiently adjust the light intensity, it is often practiced that a plurality of semiconductor light emitting elements are connected in series and the current value is changed so as to adjust the light intensity of the plurality of the semiconductor light emitting elements in serial connection simultaneously. In addition, to harden the light-hardenable ink landed on the recording medium, a number of semiconductor light emitting elements are provided.

Thus, though the voltage of the direct current power applied to each semiconductor light emitting element is low, since a number of semiconductor light emitting elements are serially connected, the voltage is increased consequently. As a result, similar to the conventional high pressure mercury lamp and low pressure mercury lamp, the problem of electrification has not been solved.

SUMMARY OF THE INVENTION

Here, an object of the present invention is to provide an inkjet apparatus where a plurality of semiconductor light emitting elements are used to be able to suppress a voltage of an output side of a power source to low levels. Also at the same time, another object of the present invention is to provide an inkjet recording apparatus where the semiconductor light emitting element emits light efficiently so as to reduce a cost of a power source circuit.

The above-mentioned problems can be solved by the following structures.

(1) An inkjet recording apparatus, having: a recording head to eject light-hardenable ink onto a recording medium; a plurality of light sources configured with semiconductor light emitting elements to radiate light onto the light-hardenable ink emitted from the recording head; a constant voltage power supply to receive an alternating current and convert into a direct current power having a predetermined voltage; a plurality of constant current circuits to convert the direct current power supplied form the constant voltage power supply into a direct current power having a predetermined current value and to supply the direct current power to the light sources; and a control section to control the current value of the direct current power supplied form the constant current circuit, wherein a plurality of the light sources are connected serially and a plurality of the constant current circuits are provided in accordance with number of blocks wherein a plurality of light sources are divided into the block having a predetermined number of the light sources or number of a plurality of the light sources.

According to the structure of (1), a plurality of the constant current circuits, which are provided corresponding to the number of the light sources in serial connection or the number of the blocks wherein the plurality of the light source are divided into the blocks having the predetermined number of the light sources, supply the direct current power having the predetermined current value in accordance with the control signal of the control section. Thereby the light sources are turned on and light is radiated onto the light-hardenable ink on the recording medium.

DETAILED DESCRIPTION OF THE PREFERRED EMBODIMENT

Embodiments of inkjet recording apparatuses related to the present invention will be described with reference to the drawings as follow.

First Embodiment

In the first embodiment of the inkjet recording apparatus related to the present invention, a case where the inkjet recording apparatus employing a serial head method is described.

Figure 1:
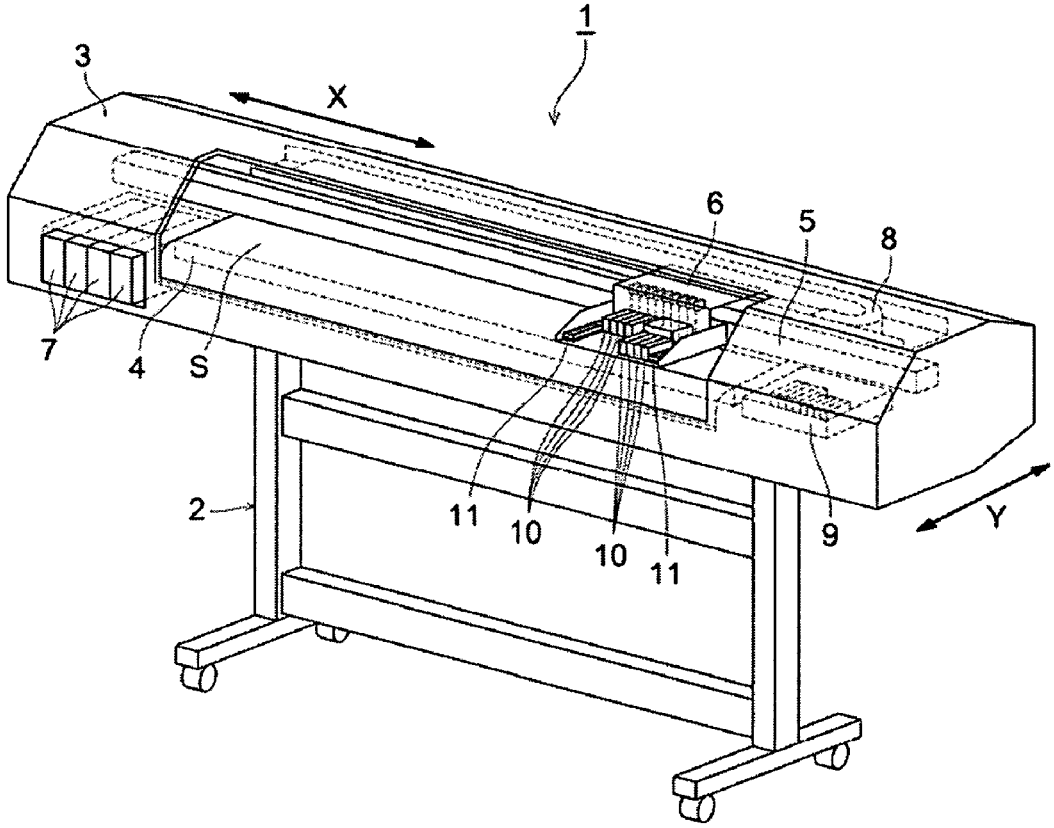
FIG. 1 is an external perspective view showing an exemplary configuration of an inkjet recording apparatus related to a first embodiment.

As FIG. 1 shows, the inkjet recording apparatus 1 related to the present embodiment is equipped with a printer main body 3 supported by a supporting stand 2. In the printer main body, a platen 4 in shape of a flat plate to support a recording medium S such as a recording sheet from a non-recording surface side is disposed substantially horizontal. On an upstream side and a downstream side of the platen 4 in a sub-scanning direction shown by an arrow Y in the figure, an unillustrated conveyance roller and an unillustrated driven roller to convey the recording medium in the sub-scanning direction Y are provided.

The conveyance roller is rotated and driven by a conveyance motor intermittently by a predetermined amount and the recording medium S is intermittently conveyed in the sub-scanning direction Y by rotation of the conveyance roller, while repeating move and stop. Meanwhile, for example, a structure where an unillustrated endless conveyance belt is trained about between the conveyance roller and the driven roller so as to convey the recording medium S in a state where the recording medium S is placed on the conveyance belt on an upper surface side of the platen 4.

Above the platen 4, a guide rail 5 in shape of a bar is provided, and a carriage 6 in shape of substantially enclosure is supported by the guide rail S. The carriage 6 reciprocates along the guide rail 5 in a main scanning direction shown by an arrow X in the figure.

On an end of the platen in the main scanning direction X, there is stored an ink tank 7 to reserve each color of ink to be ejected from a recording head 10 described later, and the ink is supplied from the ink tank 7 to the recording head 10 via a flexible tube 8. Also, on the other end of the platen 4 in the main scanning direction X, a maintenance unit 9 to clean the recording head 10 is provided.

Figure 2:
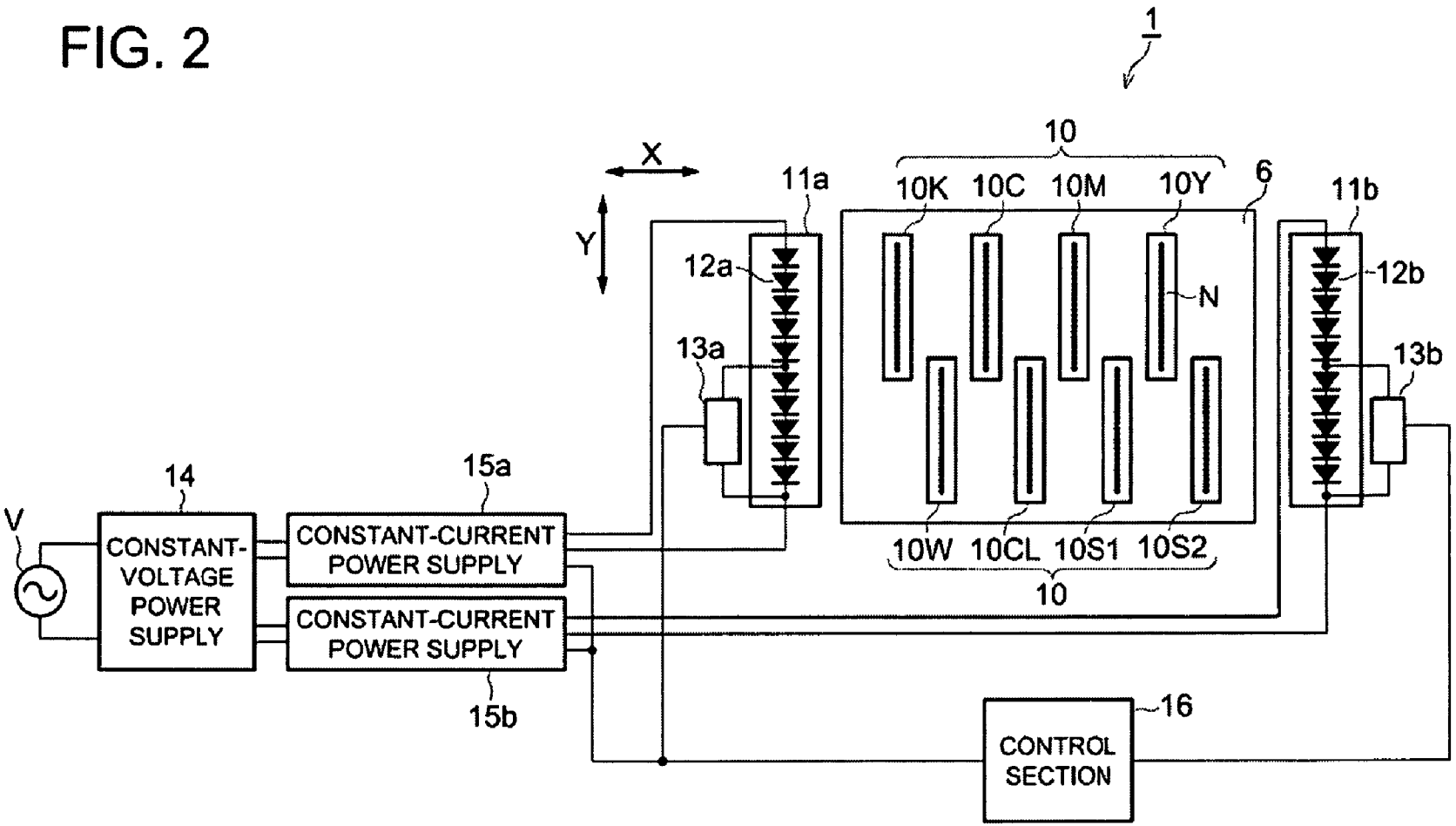
FIG. 2 is a block diagram describing a configuration of control including a carriage section of an inkjet recording apparatus.

On the carriage 6, as the block diagram of FIG. 2 shows, a plurality of the recording heads 10 are mounted in the main scanning direction X in parallel, and each recording head scans above the recording medium S in accordance with reciprocation of the carriage 6 in the main scanning direction along the guide rail 5. Meanwhile, the configuration of the recording head 10 in the carriage 6 can be other configurations than that in the FIG. 2.

On a lower surface of each recording head 10, namely a surface opposed to the recording medium S, a plurality of nozzles N are provided respectively. Also, on the recording head 10, an unillustrated piezoelectric element is arranged corresponding to each nozzle N in a way that the piezoelectric element is distorted by an electrostrictive effect corresponding to a wave shape to be applied so as to pressurize inside of an ink chamber formed behind the nozzle N, thereby the ink is ejected from each nozzle N.

In the piezoelectric element used in the present embodiment, a degree of distortion can be adjusted in accordance with the wave shape to be applied, and by changing the wave shape to be applied, an amount of ink ejected from nozzle N, namely an amount of a liquid droplet per one dot can be varied.

Meanwhile, instead of the piezoelectric element, for example, a heater element can be used. In this case, by changing the wave shape to be applied to the heater element, a degree of growth of a bubble generated and grew by heat of the heater element in the ink is changed, thereby the ejection amount of ink ejected form the nozzle can be varied. Also, it can be configured that using a recording head of so-called multi drop method, number of the drops ejected form the nozzle is changed, thereby the ejection amount of the ink ejected from the nozzle is changed.

In the present embodiment, on a first step of the carriage 6, recording heads 10Y-10 K to eject ink of each process color, yellow (Y), magenta (M), cyan (C) and black (B) are provided. Each ink is supplied to corresponding recording head 10 respectively from the each ink tank 7 to reserve the ink thereof. Each nozzle N belonging to one recording head 10 ejects the same color of ink respectively.

Also, in the present embodiment, on a second step of the carriage 6, recording heads 10W and 10CL to eject white ink and clear ink representing non-process color ink and recording heads 10S1 and 10S2 to eject special color ink such as orange and violet are provided, and in the same manner as the recording head 10 on the first step, the ink of the same color is ejected from each recording head 10W-10S2.

The ink used in the present embodiment is light-hardenable ink which is hardened by radiation of light, and in particular, ultra violet light-hardenable ink which is hardened by radiation of ultra violet light is used preferably. As a major component of the ink, at least a polymerizable compound including publicly known compound, a photo initiator and a colorant are included. As the colorant, a pigment is used preferably from a view point of whether resistance. Meanwhile, the photo initiator may not be used depending on composition of the ink.

Also, as the light-headenable ink, a radical polymerizable series ink including a radical polymerizable compound as a polymerizable compound and a cation polymerizable series ink including a cation polymerizable compound as a polymerizable compound are preferably used. Further a hybrid ink where the radical polymerizable series ink and the cation polymerizable series ink are combined can be used. Meanwhile, the cation polymerizable series ink has less or no inhibitory activity of polymerization by oxygen, and is superior in functionality and general versatility. Specifically, the cation series polymerizable ink used in the present embodiment is a compound including, for example, the cation polymerizable compound such an oxetane compound, an epoxy compound and a vinyl ether compound, a photo-cation initiator and a pigment and is provided with a property of being hardened by radiation of ultra violet light.

At both end sections of the carriage 6 in the main scanning direction X, light radiation devices 11*a* and 11*b* are provided, and inside of each light radiation device, a predetermined number of light sources 12*a* and 12*b* to radiate light onto the light-hardenable ink ejected on the recording medium S are provided. The light sources 12*a* and 12*b* are configured respectively with semiconductor light emitting elements, and as described above, since the ultra violet light hardenable ink is used in the present embodiment, an ultra violet light emitting diode (UVLED) is used as the semiconductor light emitting element.

In the present embodiment, the predetermined number of the light sources 12*a* and 12*b* provided in each light radiation device 11*a* and 11*b* configure each block, namely a predetermined number of light sources 12*a* belonging to light radiation device 11*a* configure one block and a predetermined number of light sources 12*b* belong to light radiation device 11*b* configure one block, and the light sources 12*a* and 12*b* in each block are serially connected respectively.

Figure 3:
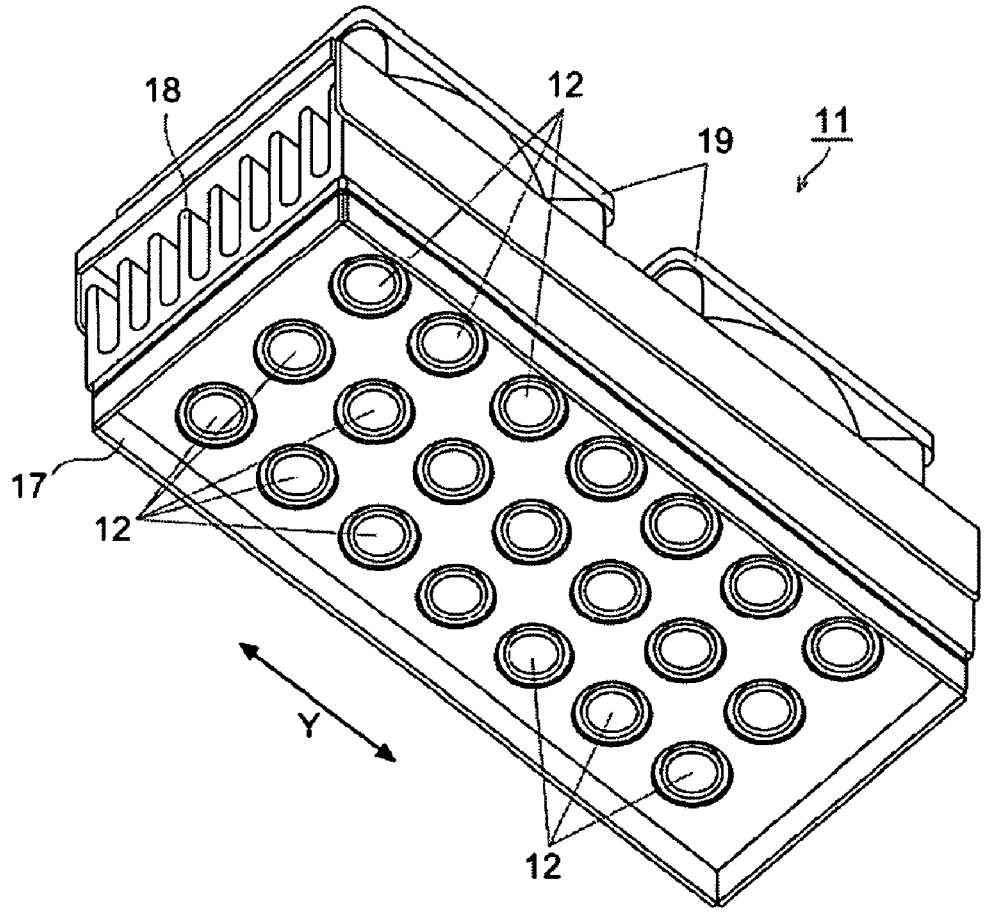
FIG. 3 is a perspective view showing an exemplary configuration of a light radiation apparatus.

Specifically, for example, the light radiation devices 11*a* and 11*b* respectively have the configurations shown in FIG. 3. In an exemplary light radiation device 11 shown in FIG. 3, a covering member 17 to prevent ultra violet light from leaking outside is provided and the ultra violet light emitting diodes representing the light sources 12 are arrayed inside the opening section of the cover member 17 along the sub-scanning direction Y in shape of a line. Also, on a surface opposite to the opening surface of the cover member 17, a heat sink 18 to radiate heat generated by the light source is provided, and on a side of the heat sink opposite to the side in contact with the cover member 17, a cooling fan 19 to forcibly discharge the heat radiated by heat sink 18 is provided.

Figure 4:
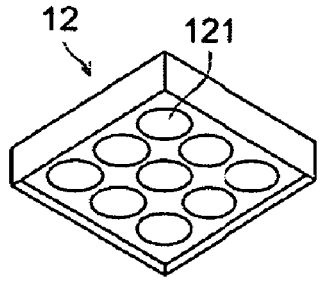
FIG. 4 is a perspective view showing a chip configured with a plurality of ultra violet light emitting diodes.

In case of light radiation device 11 in FIG. 3, for example, all the light sources 12 of the light radiation device 11 can be configured as one block, or the light sources 12 along the sub-scanning direction Y can be configured as a block for respective arrays. Meanwhile, in FIG. 3, an example where individual light sources 12 are respectively configured with one ultra violet light emitting diode is shown, however, without being limited to the example thereof, the individual light source 12 can be configured as a LED chip which is configured by a plurality of ultra violet light emitting diodes 121 shown in FIG. 4 for example.

In the present embodiment, among the plurality of the light sources configured as one block, for a light source section to radiate light onto the ink ejected from the recording heads 10W-10S2 in the second step of the carriage, short circuits 13*a* and 13*b* to lower a voltage applied to the light source section than a voltage which the semiconductor light emitting element requires to emit light are provided respectively.

In the inkjet recording apparatus 1, as a block diagram in FIG. 2 shows, a constant voltage power source 14 to receive an alternate electric power from an alternate electric power source V and to convert into a direct current power is provided. In the present embodiment, the constant voltage power source 14 outputs direct current power having a predetermined voltage not more than 60V. To the constant voltage power source 14, two constant current power sources 15*a* and 15*b* are connected independently to equate to number of the blocks of the aforesaid light sources, namely number of the light radiation devices 11*a* and 11*b*.

The constant current circuits 15*a* and 15*b* respectively convert the direct current power supplied from the constant voltage power source 14 into a direct current power having a predetermined current value in accordance with a control signal of a control section 16 described later and supply the current to the light sources 12*a* and 12*b* of each light radiation device 11*a* and 11*b*. Meanwhile, in the same manner as the constant voltage power source 14, the present embodiment is configured in a way that a voltage of the direct current power outputted from the constant current circuits 15*a* and 15*b* does not exceed 60V.

To the constant current circuits 15*a* and 15*b*, the control section 16 is connected. The control section 16 applies the control signals respectively to the constant current circuits 15*a* and 15*b* so as to control the current values of the direct current power supplied from the constant current circuits 15*a* and 15*b* to the light sources 12*a* and 12*b*.

In the present embodiment, the control section 16 makes the constant current circuits 15*a* and 15*b* to supply the electric current having at least two different current values to the light sources 12*a* and 12*b*, and changes the current values so that a light intensity of the light radiated from the light sources 12*a* and 12*b* changes as needed.

Meanwhile, the control section 16 turns off the light sources 12*a* and 12*b* which are not necessary to be turned on by making the current value of the direct current power supplied form the constant current circuits 15*a* and 15*b* to the light sources 12 and 12*b*, for example, zero amperes, or the control section 16 applies a control signal to the constant voltage power source 14 so as to stop outputting the direct current power having a specific voltage, thereby the light sources 12*a* and 12*b* can be turned off and where necessary, the light sources can be controlled to be on or off.

To the control section 16, the short-circuits 13*a* and 13*b* described above are connected. In a recording job, in case the special color ink such as white ink and clear ink are not ejected from the recording head 10W-10S2 on the second step of the carriage, and the light source sections of the light radiation apparatuses 11*a* and 11*b* radiate the light to the ink ejected from the recording head 10W-10S2 are not necessary to be turned on, the control section 16 causes a short by applying a predetermined voltage to the short-circuits 13*a* and 13*b* so that the light sources 12*a* and 12*b* in the light source section cannot be turned on though the direct current power is supplied from the constant current circuits 15*a* and 15*b* to each of light radiation devices 11*a* and 11*b*.

Next, operation of the inkjet recording apparatus 1 related to the present invention will be described.

When recording an image, the carriage 6 performs forward moving or backward moving of reciprocation in the main scanning direction above stationary recording medium S on the platen 4. Being synchronized with moving, the recording head 10 scans above the recording medium S to eject ink from the nozzle appropriately. Subsequently, along with operation of the carriage 6, the light radiation apparatuses 11*a* and 11*b* are conveyed to upper side of the ink landed on the recording medium S. Thus the ink is hardened by radiation of light and an image equivalent to a recording width corresponding to the nozzle array of the recording head 10 is recorded on the recording medium S.

Then, when the recording is completed after the recording head 10 scanning in one way in the main scanning direction X, the conveyance roller rotates so as to convey the recording medium S by a predetermined amount in the sub-scanning direction Y on the platen 4, and stops, then the recording head 10 and the light radiation apparatuses 11*a* and 11*b* scan in other way in the main scanning direction X to perform recording and then again the conveyance roller conveys the recording medium by the predetermined amount in the sub-scanning direction Y and stops. As above, scanning of the recording head in the main scanning direction X and intermittent conveyance of the recording medium S in the sub scanning direction Y via the conveyance roller are interlocked, thereby the predetermined image is recorded on the recording medium S.

In the above radiation of light, the constant current circuits 15*a* and 15*b* receive supply of a direct current power having a predetermined voltage from the constant voltage power source 14 which receives an alternative current power from the alternative current power source V and converts into the direct current power having the predetermined voltage. The constant current circuits 15*a* and 15*b* supply a direct current power having a predetermined voltage to each light radiation apparatus 11*a* and 11*b* based on the control signal of the control section 16 so as to turn on the light sources 12 and 12*b* of the light radiation apparatuses 11*a* and 11*b*.

When this occurs, the control section 16 applies a control signal to the constant current circuits 15*a* and 15*b* in accordance with an instruction inputted from an operator, kinds of recording media or a setting of conveyance speed so as to adjust the current value of the direct current power outputted from the constant circuits 15*a* and 15*b* so that the light intensity of the light radiated from the light radiation apparatuses 11*a* and 11*b* becomes a necessary level.

Also, since a plurality of the light sources 12*a* and 12*b* are connected in series, if the quantity of the light sources 12*a* and 12*b* is large, the voltage of the direct current power outputted form the constant current circuits 15*a* and 15*b* to supply a current having the predetermined current value may exceed 60V. In this case, in the present invention, the light sources 12*a* and 12*b* separated into each block are further separated into a plurality of blocks and number of the constant current circuits is increased so that one constant current circuit supplies the direct current power to one block, thereby the voltage of the direct current power supplied form the each constant current circuit cannot exceed 60 V.

Also, in a recording job where the special color ink such as white ink and clear ink are not used, the control section 16 causes a short by applying a predetermined voltage onto each short-circuit 13*a* and 13*b* so that the light source sections of the light radiation apparatuses 11*a* and 11*b* corresponding to the recording head 10W-10S2 on the second step of the carriage do not turn on. With this control, the light sources 12*a* and 12*b* of the light source section in which light radiation is not necessary are turned off so that the light radiation is not wasted.

As above, according to the inkjet recording apparatus 1 related to the present embodiment, use of the semiconductor light emitting element as the light source realizes that the voltage of the direct current power supplied to the light source is lowered, and even in case a plurality of the semiconductor light emitting elements are used, by providing the constant current circuits in accordance with the number of the light sources or the number of the light source blocks configured with a predetermined number of light sources, the voltage of the direct current power outputted from individual constant current circuits can be suppressed to low levels.

Therefore, since the voltage of the electric power supplied from a power source including a constant current circuit to the devices can be suppressed to low level, for example, when the operator places the hand in the apparatus to handle jamming, dangerousness of electrification is reduced or eliminated thus the safety of the inkjet recording apparatus is enhanced.

Also, in case the ink other than the process color is not used, by driving the short circuit to create a short in the light radiation apparatus, the light sources not necessary to be turned on can be appropriately turned off, thus the semiconductor light emitting elements can efficiently emit light and wasting of electric power is prevented.

Further, by dividing the light sources into the light source blocks configured with one light source or a predetermined number of light sources, the electric power supplied to each light source or each light source block can be suppressed not more than 60 V, thus as described above dangerousness of electrification is reduced and capacity the constant current circuit for each light source can be reduced. Thereby a cost of the power source circuit is reduced.

Meanwhile, in the present embodiment and the second embodiment, it is possible to vary the current value of the direct current power supplied to the light source continuously in a certain range, or to be discrete values. Also, usually each constant current circuit is controlled to output the current with the same current value to each light radiation apparatus, however, it is possible to output currents having different current values from respective constant current circuits by control of the control section.

Second Embodiment

In the second embodiment, a case where the inkjet recording apparatus is an apparatus of a line head method.

Figure 5:
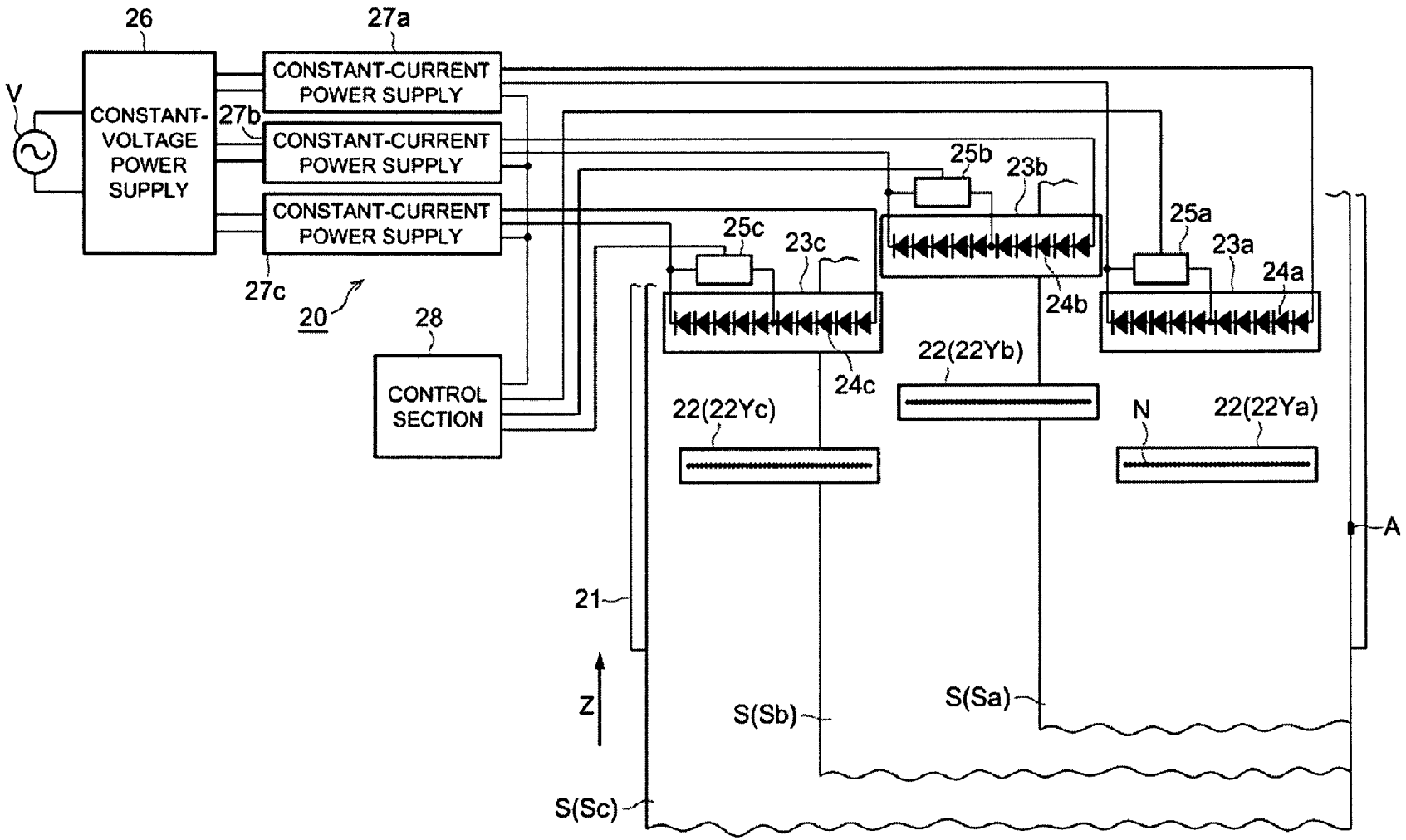
FIG. 5 is a block diagram showing a configuration of control of an inkjet recording apparatus related to a second embodiment.

In the inkjet recording apparatus 20 related to the present embodiment, as FIG. 5 shows, a platen 21 in shape of a flat plate arranged substantially horizontal supports a recording medium S from its non-recording surface, and above the recording medium S, a plurality of recording heads are arranged in parallel in a direction perpendicular to a conveyance direction of the recording medium S shown by an arrow Z in the figure.

In the present embodiment, as FIG. 5 shows, the recording head 22 to eject single color ink such as, for example, yellow (Y) is divided into three units 22Ya, 22Yb and 22Yc, and each unit 22Ya, 22Yb and 22Yc is shifted in the conveyance direction Z to be zigzag. Meanwhile, in the FIG. 5, there are described only the recording head 22 to eject yellow (Y) ink and radiation devices 23*a*-23*c* corresponding the head thereof, however other recording heads to eject other process color ink such as magenta (M) and non-process color ink such as white and the light radiation devices corresponding to the recording heads thereof are further arranged in parallel in the conveyance direction Z.

In the same manner as recording head 10 of the first embodiment, a plurality of nozzles N are formed on a lower surface of each recording head 22 and the piezoelectric elements are provided at the recording head 22. Also, the composition of the ink to be used is the same as the first embodiment.

On a downstream side of the recording head in the conveyance direction Z, light radiation devices 23*a*, 23*b*, and 23*c* corresponding to each of recording head units 22Ya, 22Yb and 22Yc are arranged with a predetermined distance from the recording head units 22Ya, 22Yb and 22Yc, and inside of each light radiation device 23*a*, 23*b* and 23*c*, a predetermined number of light sources 24*a*, 24*b* and 24*c* to radiate light onto light-hardenable ink ejected onto the recording medium S are arranged.

Each of the light sources 24*a*, 24*b* and 24*c* is configured with semiconductor light emitting elements particularly with ultra violet emitting diodes, and a predetermined number of light sources 24*a*, 24*b* and 24*c* arranged in each of the light radiation devices 23*a*, 23*b* and 23*v* configure blocks respectively. The light source arranged in the light radiation device can be configured with one LED chip or a plurality of LED chips.

Also, in the present embodiment, the light sources 24*a*, 24*b* and 24*c* in each block are connected in series respectively. Also, among the plurality of light sources in a block, for the light sources on a distant side from a base position shown by A in the figure, short-circuits 25*a*, 25*b* and 25*c* to lower the voltage applied to the light sources thereof than that the semiconductor light emitting element requires to emit light are provided.

The inkjet recording apparatus 1 is provided with a constant voltage power source 26 to receive an alternating current from an alternating current power source V and convert into a direct current power having a predetermined voltage, and the constant voltage power source 26 outputs a direct current power having predetermined voltage of not more than 60 V. Also, To the constant voltage electric power source 26, three constant current power sources 27*a*, 27*b* and 27*c* are connected independently to equate to number of the aforesaid light source blocks.

The constant current circuits 27*a*, 27*b* and 27*c* respectively convert the direct current power supplied form the constant voltage power source 26 into direct current powers having predetermined current values in accordance with a control signal of a control section 28 so as to supply the direct current powers to the light sources 24*a*, 24*b* and 24*c* of each light radiation device 23*a*, 23*b*, and 23*c*. Also, in the same manner as the aforesaid constant voltage power source 26, the present embodiment is configured in a way that the direct current powers outputted from the constant current circuits 27*a*, 27*b*, and 27*c* do not exceed 60 V.

To the constant current circuits 27*a*, 27*b* and 27*c*, the control section 28 is connected, and the control section 28 controls the current value of the direct current power supplied from the constant current circuits 27*a*, 27*b* and 27*c* to the light sources 24*a*, 24*b* and 24*c* by applying control signals to the constant current circuits 27*a*, 27*b*, and 27*c*.

In the present embodiment also, the control section 28 makes the constant current circuits 27*a*, 27*b* and 27*c* to supply the electric current having at least two different current values to the light sources 24*a* 24*b* and 24*c* to change a light intensity of the light radiated from the light sources 24*a*, 24*b* and 24*c*. Meanwhile, in the same manner as the first embodiment, the control section 28 makes the voltage value of the direct current power supplied to the light sources 24*a* 24*b* and 24*c* from the constant current circuits 27*a*, 27*b* and 27*c*, for example, zero amperes, or to stop outputting of the direct current power having the predetermined voltage from the constant voltage power source 26 so as to control on and off of the light sources 24*a*, 24*b* and 24*c* appropriately as needed.

Also, to the control section 28, short-circuits 25*a*, 25*b* and 25*c* are connected, and the control section 28 turns off the light sources 24*a*, 24*b* and 24*c* of each light radiation device 23*a*, 23*b* and 23*c* in a distant side from the base position.

Next, operation of the inkjet recording apparatus 20 related to the present invention will be explained.

When recording an image, the recording medium S is continuously conveyed in a conveyance direction Z below the recording head 22. Then, the ink ejected from the recording head 22 and landed on the recording medium S moves to a lower side of light radiation devices 23*a*, 23*b* and 23*c* along with the movement of the recording medium S, then the ink is hardened by radiation of light from the light sources 24*a*, 24*b* and 24*c* of the light radiation devices 23*a*, 23*b* and 23*c* and then the predetermined image is fixed on the recording medium S and recorded on the recording medium S.

In the above radiation of light, the constant current circuits 27*a*, 27*b* and 27*c* receive supply of a direct current power having a predetermined voltage form the constant voltage power source 26 which receives an alternative current from the alternative current power source V and converts into the direct current power having the predetermined voltage. The constant current circuits 27*a*, 27*b* and 27*c* supply a direct current power having a predetermined current value to each light radiation apparatus 23*a*, 23*b* and 23*c* based on the control signal of the control section 28 so as to turn on the light sources 24*a*, 24*b* and 24*c* of the light radiation devices 23*a*, 23*b* and 23*c*. When this occurs, the control section 28 applies a control signal to the constant current circuits 27*a*, 27*b* and 27*c* in accordance with an instruction inputted from an operator, kinds of recording media or a setting of conveyance speed so as to adjust the current value of the direct current power outputted from the constant circuits 27*a*, 27*b* and 27*c* so that the light intensity of the light radiated from the light radiation apparatuses 23*a*, 23*b* and 23*c* becomes a necessary level of light intensity.

Also, in case the quantity of the light sources 24*a*, 24*b* and 24*c* is large, the voltage of the direct current power outputted form the constant current circuits 27*a*, 27*b* and 27*c* to supply current having the predetermined current value exceed 60 V, the light sources 24*a*, 24*b* and 24*c* in a block are further separated into a plurality of blocks and number of the constant current circuits is increased so that the voltage of the direct current power supplied form the each constant current circuit do not exceed 60 V.

Also, as FIG. 5 shows, usually, the recording medium S is placed on the platen 21 in a way that an end section of the recording medium S positions at the base position A. Thus in case the sizes of the recording media S differ as recording media Sa, Sb and Sc in the figure, in case the recording mediums Sa and Sb having a narrow width in particular, ink is not ejected from nozzles N in a part of the recording head units 22Yb and 22Yc distant from the base position A. Thus the light sources 24*b* and 24*c* of the light radiation units 22Yb and 22Yc corresponding to the nozzles thereof may not necessary to be turned on.

In the above case, for example, when the size of recording medium Sb is imputed as a size of recording medium S, the control section 28 applies a predetermined voltage onto the short-circuit 25*c* to cause a short so that the light source section of the light radiation device 23*c* having the short is not turned on. Also, for example, when the size of recording medium Sa is imputed as the size of recording medium S, the control section 28 controls the constant current circuit 27C to stop supply of the direct current power from the constant current circuit 27*c* to the light radiation device 23*c* and to turn off all the light sources 24*c* and the control section 28 causes a short by applying a predetermined voltage to the short-circuit 25*b* to turn off the light source section, having the short, of the light radiation device 23*b*.

By the above control, a certain light source section of the light radiation device or a light radiation device where radiation is not necessary are turned off, thus wasting of light radiation can be prevented.

As above, according to the inkjet recording apparatus 20 related to the present embodiment, by using the semiconductor light emitting element as the light source, the voltage of the direct current power supplied to the light source also can be lowered, and in case the plurality of semiconductor light emitting elements are used, by providing the constant current circuits in accordance with the number of the light source blocks configured with a predetermined number of light sources or the number of the light sources, the direct current power outputted form the individual constant current circuit can be suppressed to low voltages.

Therefore, since the voltage of the electric power supplied from a power source including the constant current circuit to the devices, for example, when the operator places the hand in the apparatus to handle jamming, dangerousness of electrification is reduced or eliminated thus the safety of the inkjet recording apparatus is enhanced.

Also, sine the light source of the light radiation device is turned off in accordance with the size of the recording medium, and the short is caused in the light radiation device by driving the short-circuit, the light sources not necessary to be tuned on can be appropriately tuned off, thus the semiconductor light emitting element can efficiently emit light and wasting of electric power is prevented.

Further, by dividing the light sources into the light source blocks configured with one light source or a predetermined number of light sources, the electric power supplied to each light source or each light source block can be suppressed not more than 60 V, thus as described above dangerousness of electrification is reduced and capacity the constant current circuit for each light source can be reduced. Thereby a cost of the power source circuit is reduced.

Figure 6:
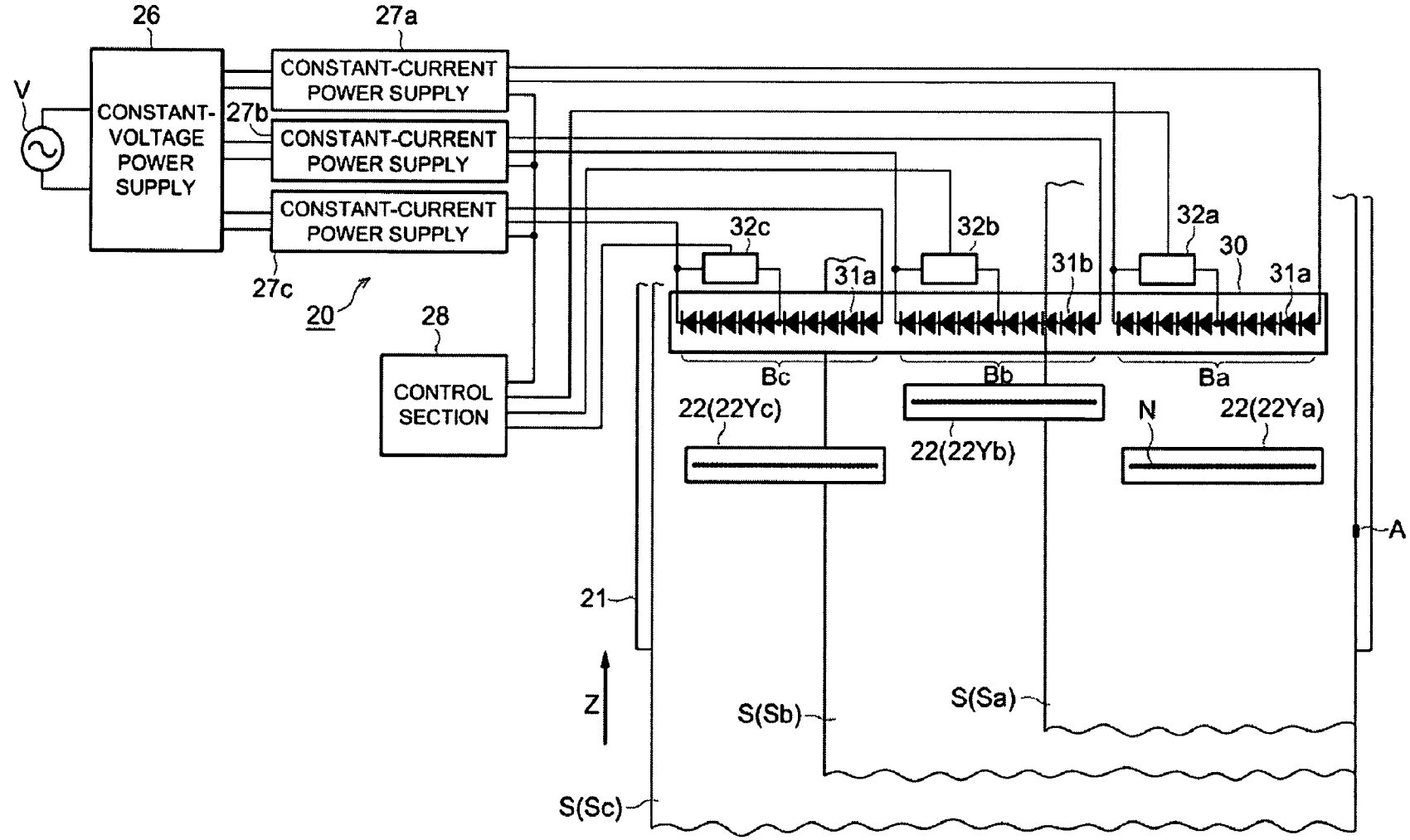
FIG. 6 is a block diagram showing a variation of configuration of control of the inkjet recording apparatus of FIG. 5

Meanwhile, in the inkjet recording apparatus 20 of line head method related to the second embodiment, as FIG. 6 shows, the light radiation device 30 is often configured as one piece of a long device.

In such case, a plurality of light sources of the light radiation device 30 are divided into a plurality of blocks Ba, Bb and Bc configured with a predetermined number of the light sources, and each of blocks Ba, Bb and Bc is connected to the constant current circuits 27*a*, 27*b* and 27*c*. Also, within the light sources 31*a*, 31*b* and 31*c* in each block Ba, Bb and Bc, for the light source section distant from the based point A, the short-circuits 32*a*, 32*b* and 32*c* are provided respectively, and each short-circuit 32*a*, 32*b* and 32*c* is controlled by control section 28. Thereby exactly the same effect as the light radiation device where the light sources are arranged zigzag shown by FIG. 5 can be obtained.

Meanwhile, in the second embodiment and an exemplary variation shown by FIG. 6, the case where the recording head 22 are divided into three units 22Ya, 22Yb and 22Yc and each of units 22Ya, 22Yb and 22Yc is shifted zigzag in the conveyance direction Z has been described. However, the present invention is not limited to the case where the number of the unit is three. Also, in a chase where the recording head is configured as one piece of long head, the present invention can be applied.

Also, in each of aforesaid embodiments and the exemplary variations, the voltage of the electric power outputted from the constant current circuit or the constant voltage power source is preferred to be lower than 60 V, as described above. Contrarily, if the voltage of the electric power is lowered excessively, the current value of the electric power outputted to the constant current circuit form the constant voltage power source for supplying a certain electric power to the devices increases, thus a loss of the electric power in wiring routs increases and a conversion efficiency of electric power circuits in the constant voltage power source or the constant current power source is deteriorated. Also, to cope with high current value, the wire has to be thickened and a cost of the wiring increases. Thus in case the voltage of the electric power outputted from the constant voltage power source or the constant current power source is lower, a lower limit of approximately 20 V is preferred.

According to the above embodiments, by using the semiconductor light emitting element as the light source, the voltage of the direct current power supplied to the light source can be lowered, and even in case a plurality of the semiconductor light emitting elements are used, by providing the constant current circuits in accordance with the number of light sources in serial connection or the number of the light source blocks configured a predetermined number of the light sources, the direct current power supplied from each constant current circuit can be suppress to low voltages.

Therefore, since the voltage of the electric power supplied from a power source including the constant current circuit to the devices, for example, when the operator places the hand in the apparatus to handle jamming, dangerousness of electrification is reduced or eliminated thus the safety of the inkjet recording apparatus is enhanced.

Further, by dividing the light sources into the light source blocks configured with one light source or a predetermined number of light sources, the electric power supplied to each light source or each light source block can be suppressed not more than 60 V, thus as described above, dangerousness of electrification is reduced and capacity the constant current circuit for each light source can be reduced. Thereby a cost of the power source circuit is reduced.

What is claimed is:

1. An inkjet recording apparatus, comprising:

a recording head to eject light-hardenable ink onto a recording medium;

a plurality of light sources configured with semiconductor light emitting elements to radiate light onto the light-hardenable ink emitted from the recording head, wherein the plurality of the light sources forms one block or a plurality of blocks;

a constant voltage power supply to receive an alternate current and convert into a direct current power having a predetermined voltage;

a plurality of constant current circuits to convert the direct current power supplied from the constant voltage power supply into a direct current power having a predetermined current value and to supply the direct current power to the light sources;

a control section to control the current value of the direct current power supplied form the constant current circuit; and a plurality of short circuits to lower a voltage applied to some of the plurality of the light sources in each of the blocks below that which is necessary to emit light, wherein the plurality of the light sources are connected serially in each of the plurality of the blocks, each of the plurality of the constant current circuits is connected to a respective one of the plurality of the blocks and each of the plurality of the blocks has a respective one of the plurality of the short circuits.

2. The inkjet recording apparatus of claim 1, wherein the predetermined voltage of the direct current power supplied from the constant voltage power supply is not more than 60 V.

3. The inkjet recording apparatus of claim 1, wherein a voltage of the current supplied from the constant current circuits is not more than 60 V.

4. The inkjet recording apparatus of claim 1, wherein the constant current circuits can supply the direct current power having at least two current values in accordance with control of the control section.

5. The inkjet recording apparatus of claim 1, wherein the semiconductor light emitting element is an ultra violet light emitting diode and each light source is configured with one ultra violet light emitting diode.

6. The inkjet recording apparatus of claim 1, wherein the semiconductor light emitting element is an ultra violet light emitting diode and the light source is a chip configured with a plurality of the ultra violet light emitting diodes.

7. The inkjet recording apparatus of claim 1, wherein the constant current circuits are provide respectively for light radiation devices in which the plurality of the light sources configured with ultra violet light emitting diodes representing the semiconductor light emitting elements are arranged.

8. The inkjet recording apparatus of claim 1, wherein the constant current circuits are provide for each block configured with a predetermined number of the light sources in a light radiation device in which the plurality of the light sources configured with ultra violet light emitting diodes representing the semiconductor light emitting elements are arranged.

* * * * *